US005515755A

United States Patent [19]

Kung

[11] Patent Number: 5,515,755

[45] Date of Patent: May 14, 1996

[54] INSULATED FASTENER RETAINER FOR FASTENER DRIVER

[76] Inventor: Sean H. Kung, 1639 W. Chanticleer Rd., Anaheim, Calif. 92802

[21] Appl. No.: 291,123

[22] Filed: Aug. 16, 1994

Related U.S. Application Data

[63] Continuation-in-part of Ser. No. 176,892, Jan. 3, 1994, abandoned.

[51] Int. Cl.[6] ..... B25B 23/10

[52] U.S. Cl. ..... 81/452; 81/3.41

[58] Field of Search ..... 81/451–454, 3.41, 81/53.1, 53.11, 53.12, 458, 184, 185.2

[56] References Cited

U.S. PATENT DOCUMENTS

| | | | |
|---|---|---|---|
| 914,174 | 3/1909 | North | 81/452 |
| 2,526,211 | 10/1950 | Erickson | 81/452 |
| 3,245,446 | 4/1966 | Morifuji | 81/452 |

*Primary Examiner*—D. S. Meislin
*Attorney, Agent, or Firm*—Roy A. Ekstrand

[57] ABSTRACT

An insulated fastener retainer includes an oval sleeve and oval ring coupled by a plurality of connectors and supporting a pair of oppositely positioned elongated beams. The beams are secured to the flat sides of the oval ring at one end and are received within insulating blocks at the outer ends. A pair of resilient jaws having grip portions are coupled to the insulating blocks and are movable in response to movement of the elongated beams. The fastener retainer is received upon a screwdriver shaft and is maintained thereon by the oval sleeve. The elongated beams and jaws are separated by the user's application of a squeezing force to the ends of the oval ring thereby distorting the oval ring and separating the fastener retainer jaws.

9 Claims, 2 Drawing Sheets

INSULATED FASTENER RETAINER FOR FASTENER DRIVER

CROSS-REFERENCE TO RELATED PATENT APPLICATION

This application is a continuation-in-part of application 08/176,892 filed Jan. 3, 1994 in the name of Sean H. Kung, now abandoned, the applicant of the present application which is hereby incorporated herein by reference.

FIELD OF THE INVENTION

This invention relates generally to fasteners and fastener drivers and particularly to those utilizing a fastener retainer for securing the fastener in position for engagement.

BACKGROUND OF THE INVENTION

Perhaps one of the most pervasive of all hand tools is found in the general category of fastener drivers often called screwdrivers or the like. The typical screwdriver has existed for a great many years and typically utilizes a generally cylindrical often insulative handle having an elongated rigid metal shaft secured thereto at one end and terminating in a fastener engaging shape at the outer end. Most common fastener shapes utilize screwdrivers having so-called blade heads in which a chisel point or straight line blade is formed at the outer end which engages a correspondingly shaped fastener having a straight slot in its head. In another type of screwdriver known generally as a Phillips screwdriver, the driver head forms a tapered generally cruciform cross-sectional member having four orthogonally oriented tapered blades which engage a corresponding receptacle in the fastener head. Other variations of the typical blade or Phillips screwdriver have been developed for specialized uses such as fasteners having "one-way" receptacles suitable for use where removal of the fastener is to be resisted as well as other combination fastener designs which accommodate both blade and Phillips-type drivers. Other related devices similar in construction are known generally as fastener drivers and utilize specialized heads such as the well known star drive fastener drivers or those utilizing hexagonal sockets generally known as nut drivers.

Regardless of the fastener shape and driver head shape, such drivers are most typically used in a two-handed operation in which the fastener is maintained in engagement with the driver head with one hand while the other hand rotates the handle thereby starting the fastener into the receiving material or aperture. In most instances, this is satisfactory. However, in many circumstances such as operation in cramped spaces or difficult to reach fastener apertures, the user is unable to maintain a hand upon the fastener to secure it to the fastener head.

To meet this difficulty, practitioners in the art have developed a variety of fastener retainers of various designs. Such designs have included retainers having spring metal jaws which grip the fastener head and maintain it in contact with the driver head as well as magnetic retainers which employ magnetized driver heads for use with fasteners made of steel or other ferromagnetic material. In addition, other specialized fasteners and fastener head designs have been provided.

As would be expected in the face of such great demand, a variety of driver designs and apparatus have been provided by practitioners in the art. For example, U.S. Pat. No. 3,498,351 issued to Edwards, et al. sets forth a SCREWDRIVER WITH SCREW-GRIPPING JAWS in which a generally conventional screwdriver having a generally cylindrical handle and elongated circular cross-section screwdriver shaft extending therefrom further includes a sliding sleeve and collar movable upon the screwdriver shaft. The sliding sleeve further supports a pair of spring jaws which are operatively moved from extended positions remote from the driver head to closed positions in proximity to the driver head to grasp the fastener head when the sleeve and collar are moved forwardly.

U.S. Pat. No. 2,789,601 issued to Lindberg sets forth a SCREW HOLDER FOR SCREW DRIVERS having a screw holder receivable upon a conventional screwdriver. The screw holder comprises a wire frame having elongated generally straight portions terminating in a pair of elliptical loop portions. The wire frame is slidably secured to the shaft of an otherwise conventional screwdriver by a sliding collar and is movable between a retracted position which withdraws the frame from the driver head and a gripping position in which the elliptical wire loops embrace opposed sides of the fastener head and maintain it in engagement with the screwdriver head.

U.S. Pat. No. 4,763,548 issued to Leibinger, et al. sets forth a SCREWDRIVER PARTICULARLY FOR SURGICAL PURPOSES having a surgical screwdriver utilizing a handle supporting an elongated generally circular cross-section shaft terminating in a screw engaging blade. A collar is slidably movable upon the screwdriver shaft and supports a pair of spring wire jaws which may be moved as the collar is moved upon the screwdriver shaft to engage the head of a fastener and retain it in engagement with the screwdriver blade.

While the prior art devices such as the foregoing described prior art devices have provided improvement in the art and in some instances enjoyed commercial success, there remains nonetheless a continuing need in the art for evermore effective fastener retainers for use with fastener drivers which are simultaneously easy to use and low in cost to manufacture.

SUMMARY OF THE INVENTION

Accordingly, it is a general object of the present invention to provide an improved fastener retainer for a fastener driver which secures the fastener in engagement with the driver head. It is a more particular object of the present invention to provide an improved fastener retainer which further provides electrical insulation between the fastener retainer and the user. It is a still more particular object of the present invention to provide an improved fastener retainer which is easy to operate and low in cost to manufacture.

In accordance with the present invention, there is provided for use in combination with a fastener driver having a handle, a shaft and a driver head adapted to engage a fastener, a fastener retainer comprises: a sleeve receivable upon the driver shaft; an oval ring having opposed closer portions and opposed farther portions; a plurality of elongated connectors supporting the oval ring in a spaced apart relationship to the sleeve; a pair of elongated beams coupled to the oval ring at the closer portions; and a pair of jaws, having fastener gripping portions, coupled to the elongated beams, the elongated beams supporting the jaws in a closed position when the oval ring is relaxed and moving the jaws to a separated open position when the opposed farther portions are forced toward each other.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2, 3:
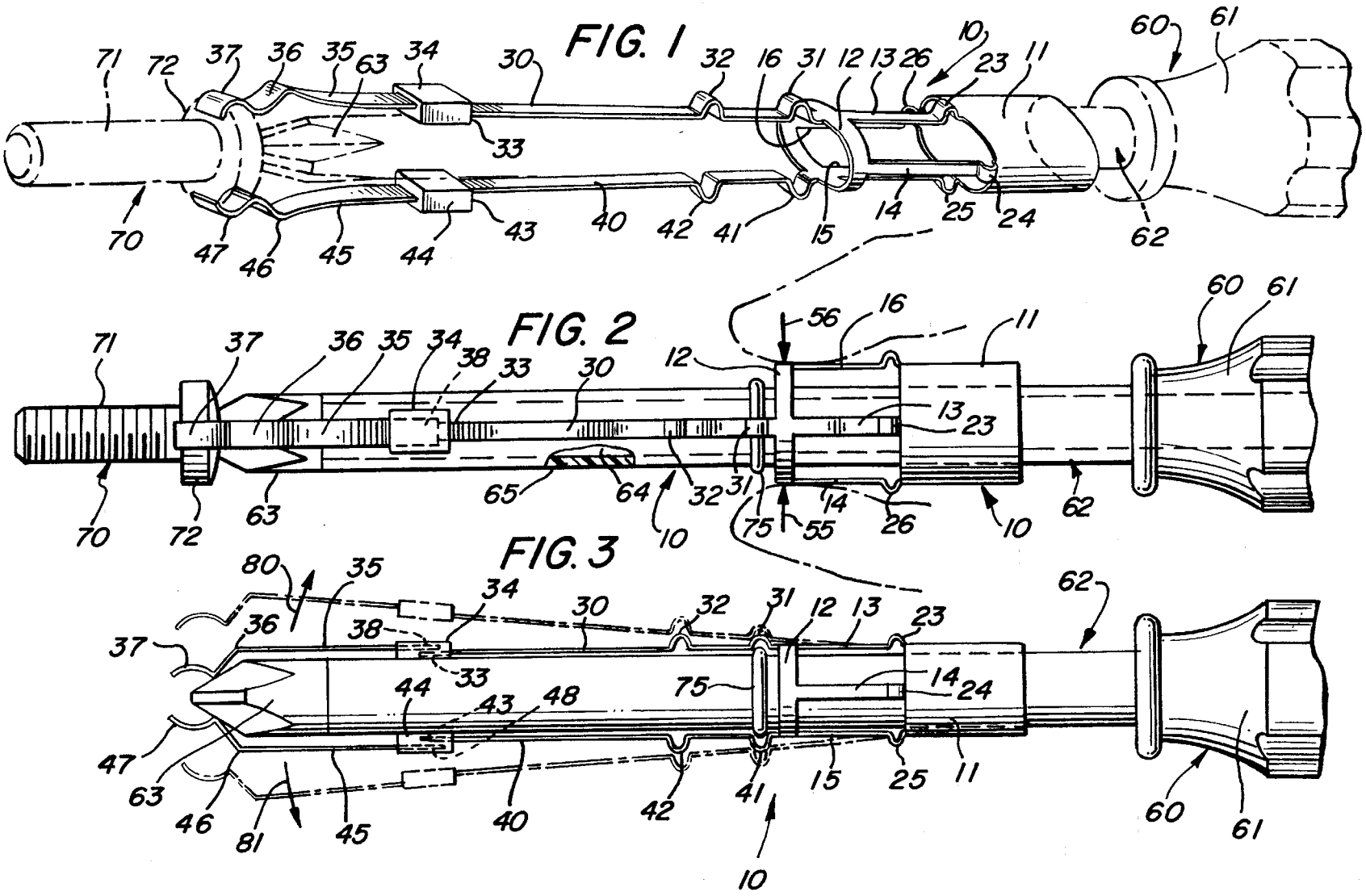
FIG. 1 sets forth a perspective view of an insulated fastener retainer constructed in accordance with the present invention showing a typical fastener driver in dashed-line.
FIG. 2 sets forth a top view of the present invention fastener retainer supported upon a cooperating fastener driver.
FIG. 3 sets forth a side view of the present invention fastener retainer supported upon a fastener driver and showing open and closed jaw positions.

FIG. 1 sets forth a perspective view of a fastener retainer constructed in accordance with the present invention and generally referenced by numeral 10. Retainer 10 is shown in combination with a typical screwdriver 60 shown in dashed-line representation and having a handle 61, a cylindrical shaft 62 and a Phillips head 63. Fastener 10 includes an oval sleeve 11 and an oval ring 12 coupled by a plurality of connector elements 13, 14, 15 and 16 equally spaced and extending between oval sleeve 11 and oval ring 12. In addition, connectors 13 through 16 define flexible bends 23 through 26 respectively near the forward edge of oval sleeve 11. Fastener 10 further includes a pair of elongated beams 30 and 40 extending forwardly from oval ring 12 and terminating in ends 33 and 43 respectively. Beam 30 extends from the top portion of oval ring 12 and defines a pair of spaced apart detent bends 31 and 32 which in turn define strengthening ribs 82 and 83 respectively. Similarly, beam 40 extends forwardly from oval ring 12 and defines a pair of detent bends 41 and 42 which in turn define strengthening ribs 84 and 85 respectively. A pair of insulating blocks 34 and 44 preferably formed of a molded plastic material or other insulating material receive ends 33 and 43 of beams 30 and 40. Ribs 82 through 85 minimize the flexing of detent bends 31, 32, 41 and 42.

Fastener retainer 10 further includes a pair of flexible spring metal jaws 35 and 45 each having ends 38 and 48 respectively (better seen in FIG. 3) which are received within and secured to insulating blocks 34 and 44 respectively. The function of insulating blocks 34 and 44 is to provide an electrical conductivity interruption between beam 30 and jaw 35 and beam 40 and jaw 45. Jaw 35 defines a flexible bend 36 and terminates in a semicylindrical grip portion 37. Similarly, jaw 45 defines a flexible bend 46 and terminates in a semicylindrical grip portion 47. In the preferred fabrication of the invention, jaws 35 and 45 are substantially more flexible than beams 30 and 40. Thus, once a fastener head is grasped by jaws 35 and 45, the jaws flex to accommodate the fastener head and beams 30 to 40 return to their straight positions close to the driver shaft as seen in FIG. 1.

In the position shown in FIG. 1, fastener retainer 10 is received upon shaft 62 of screwdriver 60 and a typical fastener generally referenced by numeral 70 and shown in dashed-line representation is received in engagement with head 63 of screwdriver 60. More specifically, fastener 70 includes a threaded shank 71 and a head 72. Head 72 defines a Phillips head receptacle corresponding to head 63 of screwdriver 60. In the position shown in FIG. 1, beams 30 and 40 are generally relaxed and thus extend generally parallely to shaft 62. As a result, jaws 35 and 45 assume their closed position allowing grip portions 37 and 47 to secure head 72 of fastener 70 in engagement with head 63 of screwdriver 60. Thus, with fastener 70 retained, screwdriver 60 may be rotated to drive fastener 70. In the event it is desired to release fastener 70, the user simply presses inwardly upon each side of oval ring 12 in the manner shown in FIG. 2 thereby flexing oval ring 12 to raise beams 30 and 40 in the manner shown in FIG. 3 and thereby separate jaws 35 and 45. Once oval ring 12 is released, the resilient character of oval ring 12 returns the oval ring to the configuration shown in FIG. 1 and thereby returns beams 30 and 40 to their generally straight line position.

In its preferred form, fastener retainer 10 is fabricated of a resilient metal such as spring steel or the like. Alternatively, however, it is recognized that fastener retainer 10 may be formed of a different resilient material such as molded plastic, fiberglass or other sufficiently strong material to provide spring resilience and sufficient strength to support jaws 35 and 45. It will also be apparent that the embodiment of the present invention shown in FIGS. 1 through 5 is formed of a single one-piece integral unit. However, as is set forth below in the alternate embodiment of FIG. 6, fastener retainer 10 may also be fabricated of a plurality of smaller elements joined using conventional attachment techniques such as welding for metal fabrication or, alternatively, adhesive or ultrasonic bonding for synthetic or plastic materials.

FIG. 2 sets forth a top view of screwdriver 60 supporting fastener retainer 10. As described above, screwdriver 60 includes a handle 61 and a cylindrical shaft 62 terminating in a screwdriver head 63. Screwdriver 60 may be fabricated entirely in accordance with conventional fabrication techniques. However, it has been found advantageous to fabricate screwdriver 60 having a shaft 62 formed of a reduced diameter steel shaft 64 and an outer insulating sleeve 65 which is integrally molded with handle 61. Preferably, the outer diameter of insulating sleeve 65 is matched to the outer diameter of head 63 and thus assumes a thickness corresponding to the diameter difference between steel shaft 64 and head 63. The fabrication of insulating sleeve 65 and handle 61 of a single one-piece molded structure provides a substantially improved outer surface having insulating characteristics without the difficulties associated with prior art devices utilizing a conventional add-on sleeve to insulate the screwdriver shaft.

As described above, fastener retainer 10 includes an oval sleeve 11 and an oval ring 12 coupled by a plurality of connectors 13 through 16 each having flexible bends 23 through 26 respectively. As is also described above, fastener retainer 10 includes a pair of elongated beams 30 and 40 (beam 40 seen in FIG. 1). Beam 30 defines a pair of detent bends 31 and 32 spaced a predetermined distance apart which will be understood to conform generally to the distance required to withdraw fastener retainer 10 away from screwdriver head 63 when jaws 35 and 45 are not in use. A detent ring 75 is secured to shaft 62 at the appropriate position with respect to detent bends 31 and 41 (the latter seen in FIG. 1) which when properly positioned grips 37 and 47 of jaws 35 and 45 to retain fastener 70 in engagement with head 63.

Thus, in the position shown in FIG. 2, detent ring 75 and detent bends 31 and 41 (the latter seen in FIG. 1) cooperate to maintain the position of fastener retainer 10 upon shaft 62. Alternatively, fastener retainer 10 may be moved toward handle 61 upon shaft 62 until detent bends 32 and 42 overlie detent ring 75. At such point, jaws 35 and 45 are withdrawn from screwdriver head 63 and screwdriver 60 may be utilized in a conventional manner.

The release of jaws 35 and 45 is accomplished by the user placing fingers and thumb on opposite sides of oval ring 12 and pushing inwardly in the directions indicated by arrows 55 and 56. The inward forces upon oval ring 12 distort oval ring 12 to the configuration shown in FIG. 5 and separate beams 30 and 40 (seen in FIG. 1) thereby separating jaws 35 and 45 and releasing fastener 70. As oval ring 12 is distorted and beams 30 and 40 are forced outwardly, connectors 14 and 16 cooperate to maintain centering and alignment of beams 30 and 40.

FIG. 3 sets forth a side view of fastener retainer 10 secured to screwdriver 60 showing the relaxed position of fastener 10 in solid-line representation and the open or flexed position of fastener retainer 10 in dashed-line representation. As described above, screwdriver 60 includes a handle 61, a shaft 62 and a head 63. Fastener retainer 10 includes a oval sleeve 11, an oval ring 12 and a plurality of connectors 13 through 16 (connector 16 shown in FIG. 1) extending therebetween. Fastener retainer 10 further includes a pair of elongated beams 30 and 40 each defining a pair of detent bends 31 and 32 and 41 and 42 respectively. Beams 30 and 40 further defines ends 33 and 43 respectively which are received within a pair of insulating blocks 34 and 44. Fastener 10 further includes a pair of resilient jaws 35 and 45 each having semicylindrical grip portions 37 and 47 respectively.

In the position shown in solid-line representation, oval ring 12 is relaxed and beams 30 and 40 lie generally parallel to shaft 62. In the event however oval ring 12 is distorted by pressing inwardly in the manner shown in FIG. 2, beams 30 and 40 are pivoted outwardly and symmetrically about flexible bends 23 and 25 due to connectors 14 and 16 thereby respectively moving jaws 35 and 45 in the directions indicated by arrows 80 and 81 to the open position shown in dashed-line representation. Once oval ring 12 is released, the resilient character of oval ring 12 returns it to the relaxed position shown in solid-line representation which in turn returns beams 30 and 40 to their normal relaxed position. Thus, the user simply flexes oval ring 12 to bend beams 30 and 40 outwardly and open jaws 35 and 45 to insert a fastener such as fastener 70 and thereafter releases oval ring 12. Once oval ring 12 has been released, the fastener is retained in the manner shown in FIGS. 1 and 2.

Figure 4:
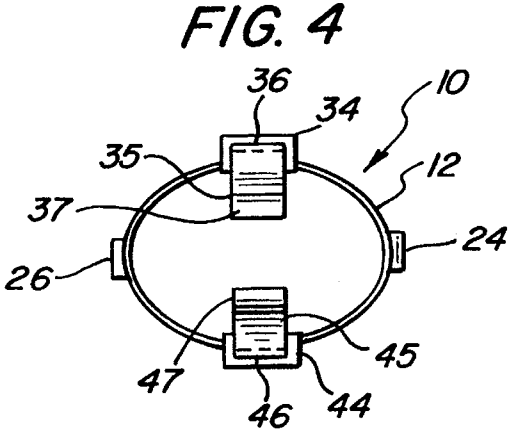
FIG. 4 sets forth a simplified front view of the present invention fastener retainer in the closed position.

FIG. 4 sets forth a simplified front view of fastener retainer 10 showing oval ring 12 in the relaxed position supporting insulating blocks 34 and 44 and having flexible bends 24 and 26 extending outwardly beyond oval ring 12. Insulating blocks 34 and 44 supports jaws 35 and 45 respectively which in turn define bends 36 and 46 and grips 37 and 47. Of importance in FIG. 4 is the observation that with oval ring 12 in its relaxed position, jaws 35 and 45 are maintained in close proximity.

Figure 5:
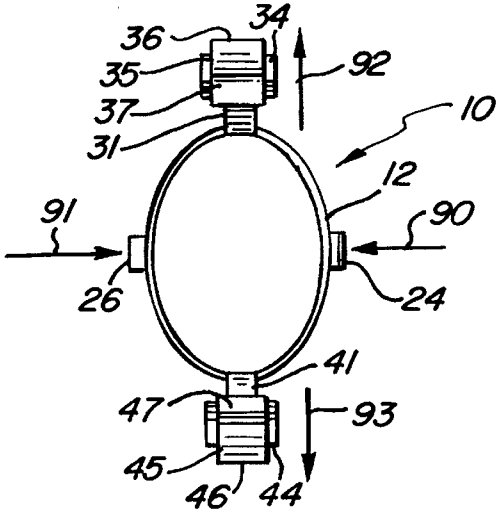
FIG. 5 sets forth a simplified front view of the present invention fastener retainer in the open position.

FIG. 5 sets forth the flexing of oval ring 12 in which inward forces are applied to each side of oval ring 12 by the user in directions indicated by arrows 90 and 91. The resulting distortion or flexing of oval ring 12 forces the opposed sides thereof apart and separates beams 30 and 40 in the directions indicated by arrows 92 and 93. The outward separation of beams 30 and 40 produces a corresponding outward movement of jaws 35 and 45. Once oval ring 12 is released however, it returns to the relaxed position shown in FIG. 4 bringing jaws 35 and 45 together.

Figure 6:
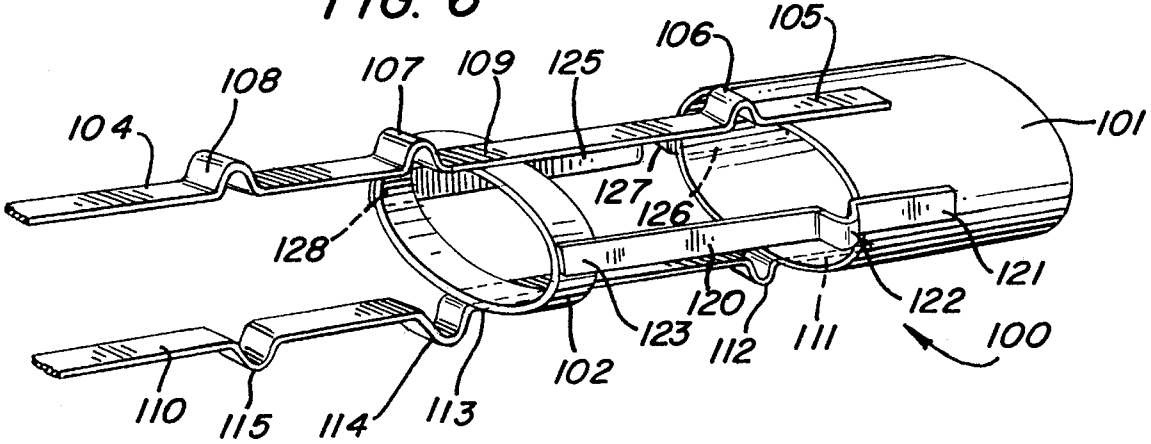
FIG. 6 sets forth a partially sectioned perspective view of an alternate embodiment of the present invention fastener retainer.

FIG. 6 sets forth a partial section perspective view of an alternate embodiment of the present invention fastener retainer generally referenced by numeral 100. It will be apparent to those skilled in the art that fastener retainer 100 is substantially similar to fastener retainer 10 set forth and described above with the primary difference being the fabrication of retainer 100 from a plurality of constituent parts assembled and joined to form the fastener retainer. More specifically, fastener retainer 100 includes an oval sleeve 101 and an oval ring 102 coupled by a pair of connectors 120 and 125 having flexible bends 122 and 127 respectively. Connectors 120 and 125 are secured to oval ring 102 at attachments 123 and 128 are secured to oval sleeve 101 at attachments 121 and 126 respectively. Fastener retainer 100 further includes a pair of beams 104 and 110 defining respective detent bends 107 and 108 and 114 and 115. Beams 104 and 110 further define flexible bends 106 and 112. Beam 104 is secured to oval ring 12 at attachment 109 and to oval sleeve 101 at attachment 105. Similarly, beam 110 is secured to oval ring 102 at attachment 113 and to oval sleeve 101 at attachment 111. In its preferred form, retainer 100 is fabricated of resilient metal parts such as spring steel or the like. In such case, the preferred attachment for attachments 105, 109, 121, 113, 128 and 126 is provided by spot welding or other equivalent attachment techniques. It will be apparent to those skilled in the art however that retainer 100 may be fabricated of other materials such as resilient molded plastic or the like without departing from the spirit and scope of the present invention. Where such molded plastic or other materials are used, it will be equally apparent that the various attachments shown in FIG. 6 may be provided by conventional sonic welding or adhesive attachment.

The embodiment of FIG. 6 further sets forth a pair of removable jaws 135 and 145 preferably formed of a resilient spring steel wire or the like. Jaw 135 is multiply curved forming an elongated loop having a pair of ends 138 and 139 and a pair of generally parallel sides forming a bend portion 136 and a grip portion 137. Jaw 135 conforms generally in shape to jaw 35 shown in FIG. 1 with the exception that jaw 135 is fabricated of a loop of spring steel or the like. A molded plastic junction block 134 defines an aperture 132 and is slidably received upon end 133 of beam 104. Beam 104 further defines a spring tab 131 extending upwardly and accessible through aperture 132. Thus, the combined assembly of jaw 135 and block 134 is slidably removable from end 133 of beam 104 by the user's insertion of a convenient narrow pointed tool through aperture 132 to depress tap 131 and release block 134 permitting it to be slidably removed.

Similarly, jaw 145 is fabricated in the same manner as described for jaw 135 and includes a loop of spring steel wire having curved ends 148 and 149 molded within a molded plastic block 144. Block 144 is slidably received upon beam 110 and secured thereto by a tab 141 which cooperates with block 144 in the manner described above for block 134 and tab 131. By way of further similarity, jaw 145 defines a bend portion 146 and a grip portion 147.

The advantage of the removable jaw structure shown in FIG. 6 is the provision of a pair of jaws which may be removed from and replaced upon beams 104 and 110 should either jaw become damaged. By way of further advantage, the use of steel wire to form grips 137 and 147 provides a more effective gripping contact upon the fastener head. In addition, the flexibility of jaws 135 and 145 permits the continued engagement of grips 137 and 147 upon a fastener head in the event a slight angular misalignment occurs between the host screwdriver and the fastener engaged thereby. Thus, the flexing action of jaws 135 and 145 facilitates slight inaccuracies and is able to maintain the engagement of the fastener head despite limited access and angular misalignment necessitated by limitations such as cramped working spaces or the like.

What has been shown is a convenient, easy to use and low cost insulated fastener retainer for a fastener driver which provides a simple squeeze operation to release a fastener and to install a new fastener. The fastener retainer is movable upon the screwdriver shaft to a withdrawn position in which the fastener jaws are remote from the screwdriver head through a simple sliding motion.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a fastener driver having a handle, a shaft and a driver head adapted to engage a fastener, a fastener retainer comprising:

a sleeve receivable upon the driver shaft;

an oval ring receivable upon the driver shaft and defining a relaxed position in which said oval ring has opposed closer portions closer to the driver shaft and opposed farther portions farther from the driver shaft;

a plurality of elongated connectors supporting said oval ring in a spaced apart relationship to said sleeve;

a pair of elongated beams coupled to said oval ring at said closer portions; and a pair of jaws, having fastener gripping portions, coupled to said elongated beams, said elongated beams supporting said jaws in a closed position when said oval ring is relaxed and moving said jaws to a separated open position when said opposed farther portions are forced toward each other.

2. A fastener retainer as set forth in claim 1 wherein said elongated connectors define flexible bends proximate said sleeve.

3. A fastener retainer as set forth in claim 2 wherein said jaws each include an electrically insulative block coupling said jaws to said elongated beams, said insulative block forming an insulative barrier therebetween.

4. A fastener retainer as set forth in claim 3 further including a detent ring supported upon the shaft of the fastener driver and wherein said elongated beams each define a pair of detent bends for receiving portions of said detent ring to detentably position said fastener retainer upon the fastener driver shaft.

5. A fastener retainer as set forth in claim 4 wherein said sleeve is generally oval.

6. A fastener retainer as set forth in claim 5 wherein the fastener driver shaft defines a reduced diameter portion extending from the handle and wherein said fastener retainer includes an insulating sleeve extending from the handle thereof and covering the reduced diameter portion and wherein said oval ring and said sleeve each define interior passages great enough to encircle the insulating sleeve.

7. For use in combination with a fastener driver having a handle, a shaft and a driver head adapted to engage a fastener, a fastener retainer comprising:

an elongated ring having first and second portions and third and fourth portions, said elongated ring received upon the driver shaft;

means for supporting said ring upon the driver shaft;

a pair of jaws; and a pair of elongated beams each having one end coupled to said first and second portions of said elongated ring and a remaining end coupled to a respective one of said jaws, said elongated rind being deformable by pressing said third and fourth portions toward the driver shaft to separate said pair of jaws.

8. A fastener retainer as set forth in claim 7 wherein said jaws each include an electrically insulative block coupling said jaws to said elongated beams, said insulative block forming an insulative barrier therebetween.

9. A fastener as set forth in claim 7 wherein said elongated ring is generally oval.

* * * * *